US012607400B2

(12) United States Patent
Pratt

(10) Patent No.: US 12,607,400 B2
(45) Date of Patent: Apr. 21, 2026

(54) DIRECT AIR CAPTURE OF CO2

(71) Applicant: Syntrees LLC, Palo Alto, CA (US)

(72) Inventor: Vaughan R. Pratt, Los Altos Hills, CA (US)

(73) Assignee: Syntrees LLC, Palo Alto, CA (US)

( * ) Notice: Subject to any disclaimer, the term of this patent is extended or adjusted under 35 U.S.C. 154(b) by 0 days.

(21) Appl. No.: 19/339,061

(22) Filed: Sep. 24, 2025

(65) Prior Publication Data

US 2026/0092736 A1 Apr. 2, 2026

Related U.S. Application Data

(60) Provisional application No. 63/700,344, filed on Sep. 27, 2024.

(51) Int. Cl.
*F25J 3/06* (2006.01)

(52) U.S. Cl.
CPC ..... *F25J 3/067* (2013.01); *F25J 3/0695* (2013.01); *F25J 2210/40* (2013.01); *F25J 2290/72* (2013.01)

(58) Field of Classification Search
CPC ..... F25J 3/067; F25J 3/0695; F25J 2210/40; F25J 2290/72; B01D 53/002
USPC ..... 95/39, 183; 62/601, 602, 640
See application file for complete search history.

(56) References Cited

U.S. PATENT DOCUMENTS 8,246,731 B2 * 8/2012 Lackner ..... B01D 53/62 96/371
11,648,507 B2 * 5/2023 Peng ..... B01D 53/62 423/220
2010/0135882 A1 * 6/2010 Constantz ..... C02F 1/683 423/234
2014/0079594 A1 * 3/2014 Caldeira ..... F17C 1/007 422/232
2019/0120213 A1 4/2019 Pederson

OTHER PUBLICATIONS

Avellaneda et al. Dynamic analysis of a floating wind turbine platform with on-board CO2 direct air capture, Ocean Engineering, vol. 308, 2024, 118205, ISSN 0029-8018, https://doi.org/10.1016/j.oceaneng.2024.118205 (https://www.sciencedirect.com/science/article/pii/S0029801824015439. May 31, 2024.
Mark A. Pederson. An Efficient Heat Engine for Oceanthermal Energy Conversion, Kansas City, Missouri, 2022.

* cited by examiner

*Primary Examiner* — Frank M Lawrence, Jr.
(74) *Attorney, Agent, or Firm* — Van Pelt, Yi & James LLP

(57) ABSTRACT

A system to remove CO2 from the air using ocean thermal energy conversion is disclosed. The system includes a pair of substantially vertically oriented concentric tapered tubular structures disposed in the ocean, with an upper end at or near the surface and a lower end at ocean depth. The tubular structures define an inner, substantially cylindrical air pathway and an outer, substantially annular pathway. Each of one or more bifans at corresponding axial locations along a central vertical axis of the tubular structures includes an inner set of fan blades disposed in the inner air pathway and an outer set of fan blades disposed in the outer pathway. In one airway air is compressed isothermally and moved to a deep end of the system while air returning and expanding isothermally via the other airway drives the bifan(s), which provides the compression and drives a motor to generate electricity.

22 Claims, 6 Drawing Sheets

DIRECT AIR CAPTURE OF CO2

CROSS REFERENCE TO OTHER APPLICATIONS

This application claims priority to U.S. Provisional Patent Application No. 63/700,344 entitled DIRECT AIR CAPTURE OF CO2 filed Sep. 27, 2024 which is incorporated herein by reference for all purposes.

BACKGROUND OF THE INVENTION

Atmospheric $CO_2$ is currently at 420 ppm (parts per million). Assuming it continues to rise by 3 ppm per year, then to cap CO2 at 450 ppm by 2035 with direct air capture it will be necessary to process 1% of the atmosphere a year or 1.6 million tons of air a second.

Currently techniques that remove CO2 from the atmosphere includes various natural (and assisted natural) approaches, such as afforestation, and industrial processes, such as Direct Air Capture (DAC), which uses sorbent materials to capture CO2 from ambient air, which can then be sequestered underground or converted into products.

Current techniques may not scale to the level required to achieve the above-stated goal to cap CO2 at 450 ppm by 2035. For example, energy and other requirements may make it infeasible for current techniques to process 1% of the atmosphere a year.

BRIEF DESCRIPTION OF THE DRA WINGS

Various embodiments of the invention are disclosed in the following detailed description and the accompanying drawings.

Figure 6A:
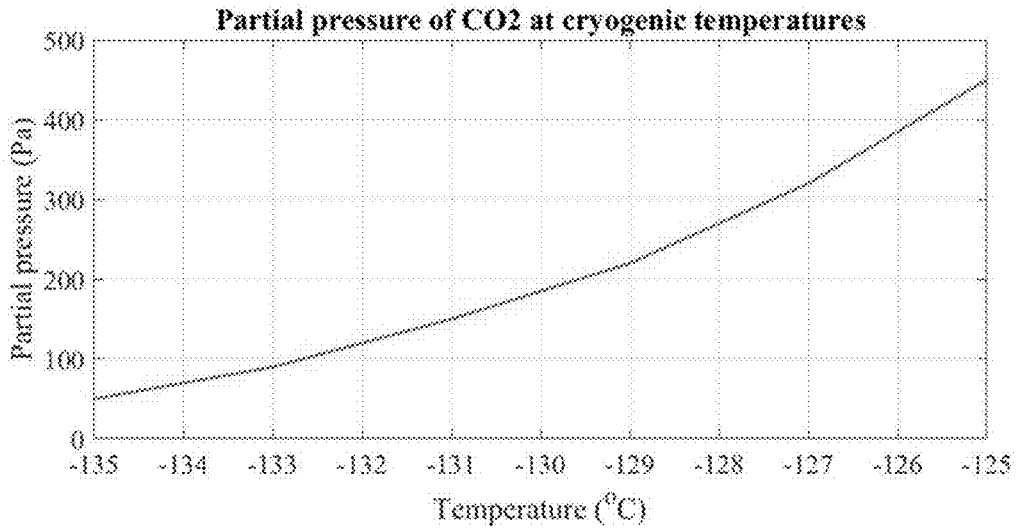
FIG. 6A is a graph showing the partial pressure of CO2 at cryogenic temperatures.
Figure 6B:
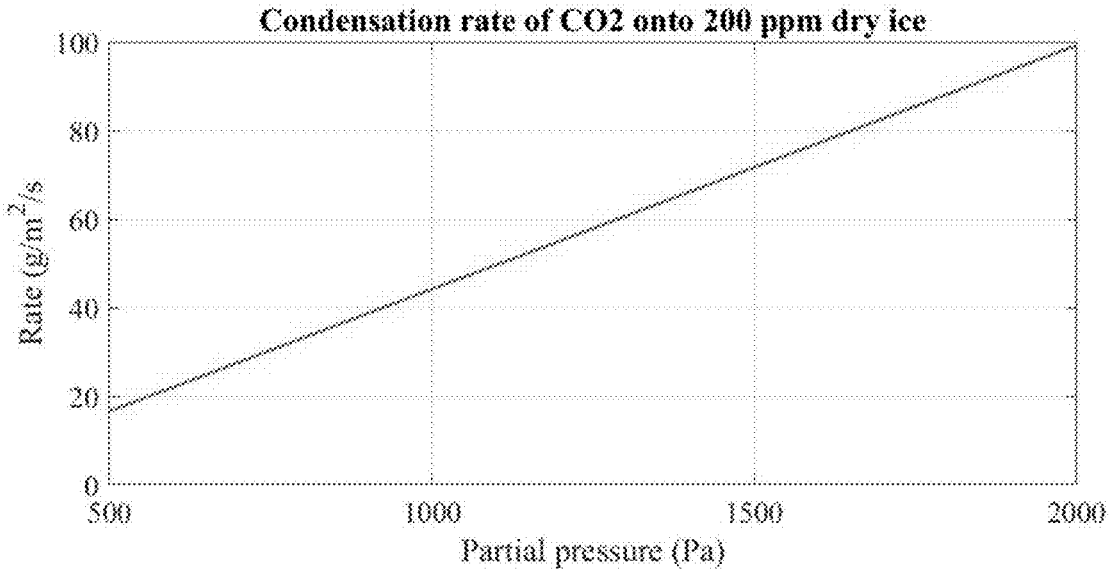

FIG. 6B graphs the condensation rate of CO2 onto 200 ppm of dry ice.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system is disclosed to perform direct air capture of CO2 and/or other useful work at sea. A momentum preserving bifan is disclosed, which in various embodiments is used to compress air, e.g., in stages, as the air is transported to an ocean depth via a substantially vertical intake path. Cold water from the deep ocean is used to cool the air as it is compressed. At the ocean depth, the cooled, compressed air is used to perform direct air capture of CO2 and/or other useful work prior to being warmed and returned to the surface via a substantially vertical return pathway. Warm water, e.g., from the ocean thermal layer, is used to warm the air as it expands. The expanding air drives blades of the bifans in the return pathway, powering the compression of air in the intake pathway and generating electricity.

Atmospheric $CO_2$ is currently at 420 ppm. Assuming it continues to rise by 3 ppm per year, to cap CO2 at 450 ppm by 2035 with direct air capture it will be necessary to process 1% of the atmosphere a year or 1.6 million tons of air a second.

In various embodiments, this is accomplished with many devices, e.g., 10,000 devices, each capable of compressing air to sufficient pressure to remove CO2 and scalable in practice to process, for example, 160 tons a second. In various embodiments, each such device is powered by OTECA, Ocean Thermal Energy Compression with Air as its working fluid.

In various embodiments, a system as disclosed herein captures CO2 directly from the air at a rate sufficient to stop climate from rising above the Paris Accord's 1.5° C. guard rail above preindustrial CO2. With climate suitably defined, that level is expected to be reached by 2035, giving four years to build and deploy a system as disclosed herein and six more to ramp up its scale, for example. By then we expect CO2 to have reached 450 ppm and be rising at 3.6 ppm a year.

In various embodiments, a system as disclosed herein removes 80% of the CO2 in the air it processes before returning it to the atmosphere. It will therefore need to process air containing 3.6/0.8=4.5 of the atmosphere's 450 ppm per year, or 1%. Using 5,100 teratons for the mass of the atmosphere, 1% comes to 51 teratons a year. There being 31.56 million seconds in a year, air needs to be processed at 51/31.56=1.62 million tons a second.

For convenience of arithmetic in the division of this labor, in various embodiments, we target a slightly higher rate of 68=1,679,616 tons per second. We divide this up as 2*81*81*128. In one example, the labor is divided up between 81 sovereign parties under the aegis of the United Nations and 81 "parties with sovereigns" of the kind found for example at the annual SME meeting at Davos.

At the end of 2029, each party will take charge of one small, hence more affordable, synthetic tree at generation 0 and use it to grow a "forest" of 81 trees in seven generations according to the "tribonacci" sequence, an extension of the Fibonacci sequence where each term is the sum of the three preceding terms, starting with a specific set of initial values, e.g., 1,1,2,4,7,13,24,44,81, . . . . Each tree is responsible for producing one slightly larger tree per generation before being retired after three generations.

At generation 7 the party will be managing 13+24+44=81 fully grown trees, 13 of which be retired at generation 8. Thereafter only 27 trees need be produced per generation so as to maintain the forest at 81 trees.

In various embodiments, the labor of operating, servicing, and producing trees is divided between humans and machines.

While one example of how systems as disclosed herein may be built and deployed at scale is provided above, in other embodiments other approaches may be used, such as other approaches to how a fully grown synthetic tree system as disclosed herein can be built and deployed to process 128 tons of air per second and how it can be serviced.

In various embodiments, a system as disclosed herein comprises a composable compressor comprising substantially vertically oriented concentric tapered tubular structures, such as concentric conical frustums. The structures include an inner tube (or frustum) that defines a substantially cylindrical inner pathway for air to travel in a first substantially axial direction and an outer shell having a shell diameter that is larger than an inner tube diameter of the inner tube, an inner surface of the outer shell and an outer surface of the inner tube defining a substantially annular pathway for air to travel in a second substantially axial direction substantially opposite the first substantially axial direction.

In various embodiments, one or more bifans are rotatably mounted each at a corresponding axial location along a central vertical axis of the pair of substantially vertically oriented concentric tapered tubular structures, each bifan comprising an inner set of fan blades disposed in the substantially cylindrical pathway defined by the inner tube and an oppositely pitched outer set of fan blades disposed in the substantially annular pathway between the inner tube and the outer shell. Each bifan has associated therewith a motor configured to operate in a motor mode to drive the bifan (both sets of blades) and a generator mode to generate electricity when driven by air flowing upward through either the inner set of fan blades or the outer set of fan blades of the bifan, depending on which pathway is used as the return pathway.

The system draws air from above into the intake pathway, which is compressed by the bifan, and is delivered below at higher pressure. Conversely air enters the return pathway from the bottom, expands while driving the bifan, and is delivered above at lower pressure.

Figure 1:
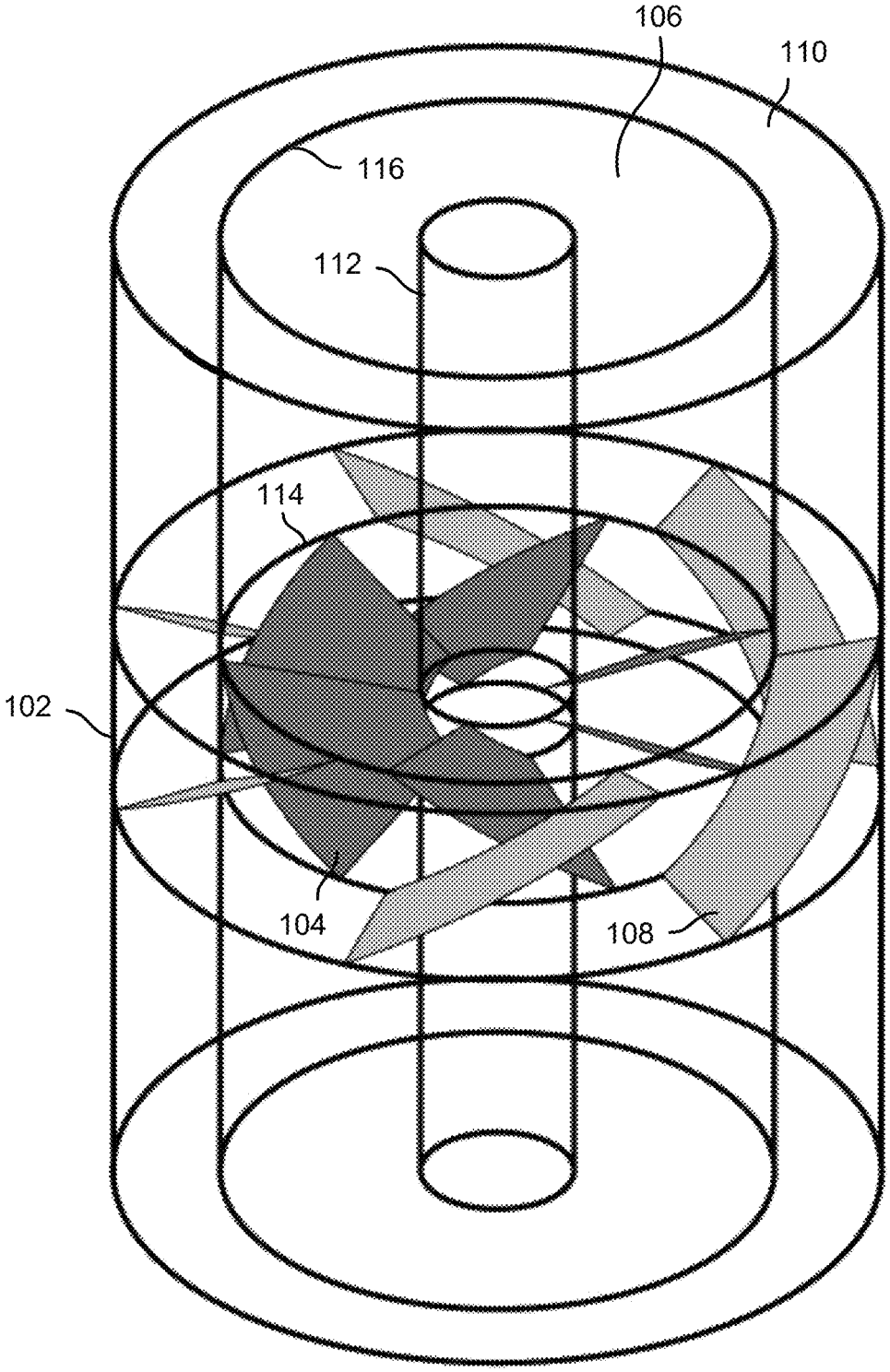
FIG. 1 illustrates an embodiment of a momentum conserving bifan.

FIG. 1 illustrates an embodiment of a bifan as disclosed herein. Each bifan 102 includes a first set of fan/turbine blades 104 in the intake pathway and a second set of fan/turbine blades 108 in the return pathway 110. The blades in the first set 104 are oriented (pitched) oppositely to those of the second set 108, so as to compress downflowing air in the intake pathway 106 (air driven by blades 104 rotating clockwise, as viewed from the top) while the blades of the second set 108 air driven by air expanding and rising through the return pathway 110. In the example shown in FIG. 1, the bifan 102 is driven by (or drives) a motor, not shown, coupled to a central shaft 112, however in other embodiments the blades 104, 108 of the bifan 102 may be attached to a rotating section of the inner tube 116 and the shaft 112 may be omitted.

In various embodiments, by maintaining the air in the return pathway at higher temperature than the intake pathway, the expanding air in the return pathway drives the bifan with more power than is needed to compress the intake air. Hence some of the power of the expanding air in the return pathway is left over for other purposes, making the compressor a heat engine developing power usable for industrial purposes.

While in the example shown in FIG. 1 the intake pathway 106 is the central, substantially cylindrical pathway and the return pathway 110 is the outer, annular pathway, in other embodiments the direction of airflow in each pathway is switched, with air entering and being compressed via the outer, annular pathway and returned via the central, substantially cylindrical pathway.

In some embodiments, in addition to the heat differential, the bifan generates more power than needed to compress air on the intake side in part by sizing the inner, cylindrical and outer, annular pathways such that at all heights (i.e., ocean depths) the cross-sectional area of the return pathway is smaller than the cross-sectional area of the corresponding part of the intake pathway, e.g., 5% smaller, resulting in air moving through the return pathway at a slightly higher velocity that in the corresponding part of the intake pathway. In some embodiments, the cross-sectional areas of the inner, substantially cylindrical and outer, annular pathways a tapered at a rate calculated to result in a first substantially constant air velocity as air travels to the ocean depth via the intake path and a second substantially constant air velocity, higher than the first, as air returns via the return pathway.

In various embodiments, the inner and outer blades sets 104, 108 comprising a bifan 102 may be mounted on a rotatable section 114 of the inner tube 116. Optionally the portions of the inner tube 116 above and below a bifan's blades and motor can be stationary, with suitable seals between the stationary and rotating portions of the inner tube.

A motor-generator, for example a three-phase AC motor, consists of a rotating part attached to the rotor and a stator attached to the various non-rotating parts of the compressor. In motor mode, externally provided electricity starts up bifan rotation. In generator mode, electricity is generated by ongoing bifan rotation and is delivered into a suitable load, limiting rotation while supplying 12*R/4=25 joules of mechanical energy per mole of air processed per stage.

Figure 2:
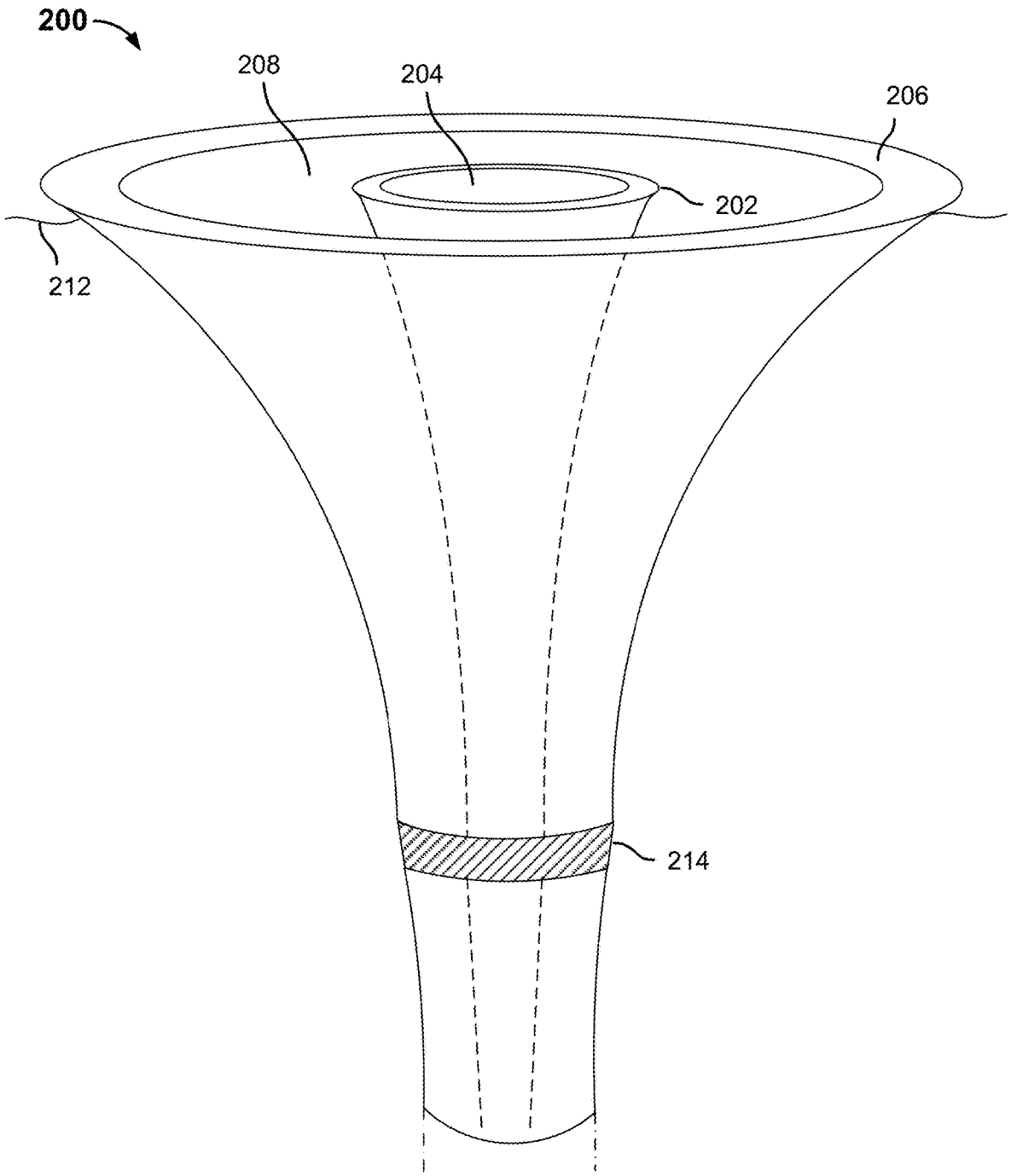
FIG. 2 illustrates the upper stage and first bifan of an embodiment of a compressor as disclosed herein.

FIG. 2 illustrates the upper stage and first bifan of an embodiment of a compressor as disclosed herein. In the example shown, the compressor 200 includes an inner tube 202 defining an inner, substantially cylindrical air pathway 204 and an outer shell 206, the outer surface of inner tube 204 and the inner surface of outer shell 206 defining an outer, substantially annular air pathway 208 between them. The compressor 200 is shown to be positioned with the upper openings of the respective air pathways 204, 208 being a distance above the surface 212 of the ocean, e.g., 10 meters or more, to avoid inadvertent ingestion of seawater into the air pathways. The compressor 200 includes a first stage bifan 214, e.g., a bifan as shown in FIG. 1, configured to compress intake air drawn into and passing through the inner, substantially cylindrical air pathway 204, in various embodiments, and to be driven by relatively warm, expanding air being returned via the outer, substantially annular air pathway 208, or vice versa in alternative embodiments.

In various embodiments, compressors are made composable by matching the bottom dimensions of one compressor to the top dimensions of another to form a multistage compressor.

Figure 3:
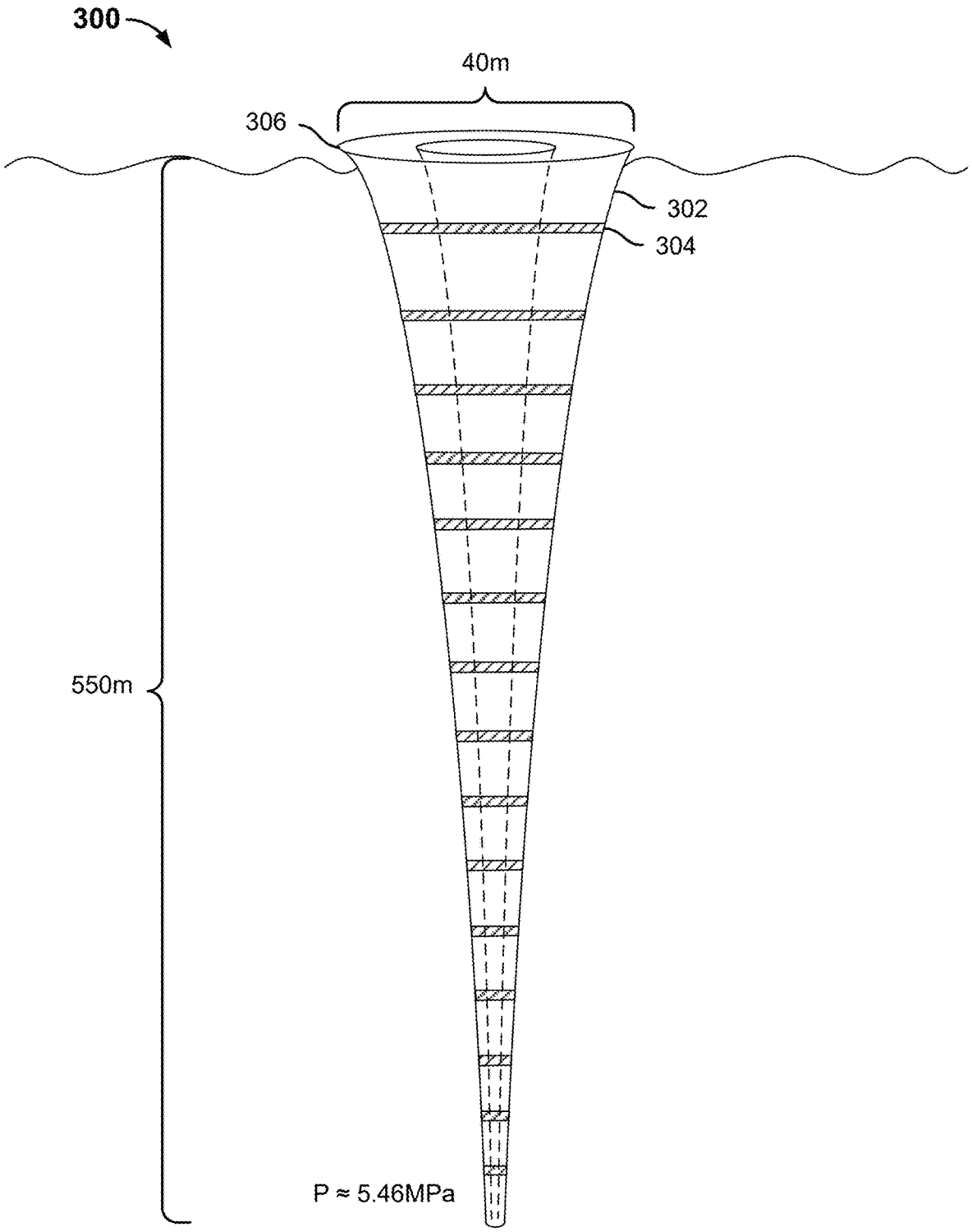
FIG. 3 shows an embodiment of a multistage compressor comprising sixteen segments of equal length.

FIG. 3 shows an embodiment of a multistage compressor comprising sixteen segments of equal length. In the example shown, compressor 300 comprises sixteen stages, starting with uppermost stage 302 each pair of stages having a bifan 304 between them, in this example. In some embodiments, a bifan may be located other than between stages, such as halfway between the top and bottom of each stage. In some cases, a stage may include more than one bifan or no bifan. In the example shown, the compressor 300 is 40 meters wide at the top and extends to a depth of about 550 meters. In this example, air is compressed to 54.6 bars or 5.46 MPa, which approximates the pressure of water at that depth. In various embodiments, compressor 300 compresses air in each stage to maintain an internal pressure that approximates the pressure the ocean water exerts at that depth, to minimize stress on the outer shell and other structures comprising the compressor 300.

For illustration we assume the area of the top of each stage is $e^{1/4}$=1.284 times the area of the bottom, whence at each stage, compression and expansion change both pressure and volume by that ratio assuming constant temperature. Diameter and radius therefore decrease going down by $e^{1/8}$=1.133 from stage to stage. In various embodiments, a compressor as disclosed herein includes a sufficient number of stages to bring the pressure up to $e^4$=54.6 atmospheres, e.g., at an ocean depth of approximately 550 m.

Without introducing or removing heat, the compression and expansion would both be adiabatic, with compression heating and expansion cooling. At each stage the temperature changes by a factor of $e^{0.1}$=1.105. Hence compression warms air at 10° C.=283K to 283×1.105=313K while expansion cools air at 22° C.=295K to 295/1.105=267K. To make both isothermal, the air in the return pathway is warmed with sufficient oceanic mixed layer (OML) water at 28° C. to maintain it at 22° C., while the air in the intake pathway is cooled with sufficient ocean deep water at 4° C. to maintain it at 10° C. In some embodiments, for both pathways, 25 ml of water sprayed into the air stream per mole of air suffices. In some embodiments, heat exchangers embedded in or otherwise integrated with or adjacent to the outermost structure(s) defining a pathway are used to heat or cool air in the pathway.

As an alternative to using seawater directly for thermal management, in some embodiments, rainwater is accumulated in adjacent reservoirs and brought to the hot and cold seawater temperatures using heat exchangers. Being fresh, it will tend to dissolve atmospheric CO2. If recycled it will gradually turn to carbonic acid and no longer be able to absorb CO2, important if the CO2 is to be used in manufacturing instead of being sequestered.

Expansion does work, and compression needs work, equal to $$\int_{e^a}^{e^b} p(V)dV$$

when the volume changes from $e^a$ to $e^b$. Using p(V)=RT/V, this integral comes to (b−a)RT joules per mole of air. In various embodiments, the expansion or compression by one stage is by a factor of $e^{1/4}$, this comes to RT/4=2.0786T. The work done by expansion in excess of that needed by compression is 2.0786*(295-283)=25 joules per mole per stage. The load is adjusted so as to draw off 12.5 joules per mole per stage, which is then available to provide energy for industrial purposes. The other 12.5 joules accelerates the rotor until drag and other losses consumes that energy.

In various embodiments, compressed air at the bottom of a compressor as disclosed herein is used to perform work and/or in an industrial process, such as CO2 removal. When the remaining CO2 molecules are down to 100 ppm, the resulting "clean" air is heated to 22° C. and returned to the bottom of the return pathway to eventually return to the atmosphere after being routed well away from the mouth of the intake pathway, i.e., where air enters the intake pathway, at or near the ocean surface.

Scalability

In some embodiments, a plurality of systems as disclosed herein are deployed and used to compress 160 tons of air per second, that comes to 160/28.97=5.5 megamoles, or 125,000 m3, per second. This would generate as a side benefit 256×5.5=1400 megajoules per second, or 1.4 gigawatts. The 10,000 devices as disclosed herein that would be needed to cap CO2 at 450 ppm would therefore generate 14 terawatts, slightly less than the 18.4 terawatts of power the whole of planet Earth's civilization currently consumes.

A hundred synthetic island nations on the Intertropical Convergence Zone or ITCZ in the Pacific and Atlantic, each equipped with a hundred such devices, with each device manned by between 100 and 1000 personnel in various supporting roles, would each have 140 gigawatts of power per island usable for industrial and other purposes. The Conference of Parties (COP) to the various climate agreements (Kyoto, Paris) should be able to find enough Parties willing to participate in constructing these during the coming ten years.

The cross-sectional area of the entrance to the intake pathway should be as large as needed such that when 16 joules of energy per mole of air per stage are drawn off for industrial and related purposes, air enters the intake pathway at the above-mentioned rate of 125,000 m3 per second. This area can be expected to be on the order of 500 m2, in which case the velocity throughout the intake will be 125000/500=250 m2. If it turns out that 625 m2 is needed, the velocity will be 200 m2, and so on. Alternatively, the number of devices can be increased above 10,000 to cap CO2 at 250 ppm by 2035.

CO2 Disposal

In various embodiments, CO2 removed from the compressed air is sequestered by pumping it to a depth of 4 km where its density will exceed that of the deep sea water. It will then sink to the ocean floor, ideally on benthic deserts Synthetic trees. Alternatively the available industrial energy can be used to combine the CO2 with other readily available elements such as hydrogen, oxygen, nitrogen, argon, sodium, chlorine, calcium, and other ocean salts to manufacture glucose, cellulose, various plastics, etc. An extension of the device by an additional 1 km to depth 1.5 km would create the 15 MPa sufficient to manufacture ammonia.

Tribonacci Growth

In this section we describe how one synthetic tree can be used to create 80 more trees in seven cycles. A cycle may take more or less than a year. The basis for this growth is the tribonacci number sequence starting with 0,0,1,1,2,4,7,13, 24,44. This sequence can be found in the Online Encyclopedia of Integer Sequences as A000073. We assume each tree can be used to produce one tree per cycle and can be used for that purpose during three consecutive cycles.

Starting with 0,0,1, which we take as cycle zero with one starter tree, each number in the sequence thereafter is the sum of the preceding three numbers. So in cycle one, the starter tree produces a second tree. In cycle two, the two trees produce two more trees for a total of four trees. In cycle three the four trees produce another four trees. At the end of that cycle, having now produced three trees the starter tree is recycled. In cycle four the remaining seven trees produce another seven trees and then another tree is recycled. In cycle five thirteen trees are created and then two trees are recycled.

This continues until cycle seven, which starts with 7+13+24=44 trees that produce another 44 trees for a total of 88 trees and then recycles 7 trees leaving 81 trees.

From then on, trees are created at a rate sufficient to maintain the forest population at 81. This could be accomplished by continuing the above sequence as 13,24,44,13, 24,44 etc. Alternatively, it could continue as 27,27,27 etc, which would result in 81+27−13=95 trees in cycle 8, 95+27−24=98 trees in cycle 9, and back down to a constant 98-44+27=81 trees thereafter.

Composition of Trees

Each tree can be constructed almost entirely from locally sourced materials under the management of a suitably sized and salaried work crew. Plastics such as ABS require carbon, hydrogen, and nitrogen. The carbon can be extracted from the captured CO2, whose enthalpy of formation is −393 kj/mol. Hydrogen can be obtained by hydrolyzing the copious rainwater in the ITCZ at an enthalpy of formation of −285.8 kj/mol. Nitrogen can be obtained by removing oxygen from air. The tree's electrical energy of 880 MW yields 27 petajoules per year, far more than is needed to make all the materials for one tree in one year.

Ocean Thermal Energy Conversion

OTEC is notoriously inefficient. It can be calculated from the "25 ml of water sprayed into the air stream per mole of air" described earlier that converting ocean thermal energy to mechanical energy will require 84 GW to produce 1.76 GW of mechanical energy, which is then divided equally between compressing 128 tons of air per second and generating electrical energy to operate everything else. This constitutes an efficiency of 2.1%, only a tenth of the typical efficiency of a solar panel.

The average solar energy in the ITCZ is 200 watts/m2. By operating the 13,122 syntrees in five million square kilometers of the ITCZ, this constitutes a warming energy of 1 petawatt. 2.1% of this is 21 TW, which divided among 13,122 trees comes to 1.6 GW, slightly less than our target of 1.76 GW per tree. A straightforward approach to closing this gap is to operate the trees in six million square kilometers. Another approach would be to spread a sufficiently large black sheet of plastic around each tree at a depth of ten meters to enhance solar warming of the tree's neighborhood. We propose to investigate these and other approaches to closing the gap.

Division of Labor at Scale

As noted at the beginning, approximately 1.6 million tons of air per second need to be processed to pull down 3.4 ppm of CO2 per year. As a convenient method of organizing the division of labor, this number can be taken to be the integer $6^8$=1,679, 616, which in base 6 notation where $2\times3=10_6$ is written 100,000,0006. This "round number" factors conveniently as 2×81×81×128, thereby accounting for two classes each of 81 parties each managing a forest of 81 trees each processing 128 tons of air per second.

With that division of labor, the factorization we had previously suggested in this application, namely 10,000 trees each processing 160 tons per second, now becomes 13,122 trees each processing 128 tons per second. The area A at the top of a tree becomes 1024 m2 while the velocity v can now be decreased to 100 m/s.

Use of Heat Exchangers

Cooling the intake air with water droplets may result in too much water in the condensation chamber at the bottom of the tree. In various embodiments, the cooling water is separated from the air in the intake pathway by using a suitably designed heat exchanger constructed from plastic.

Figure 4:
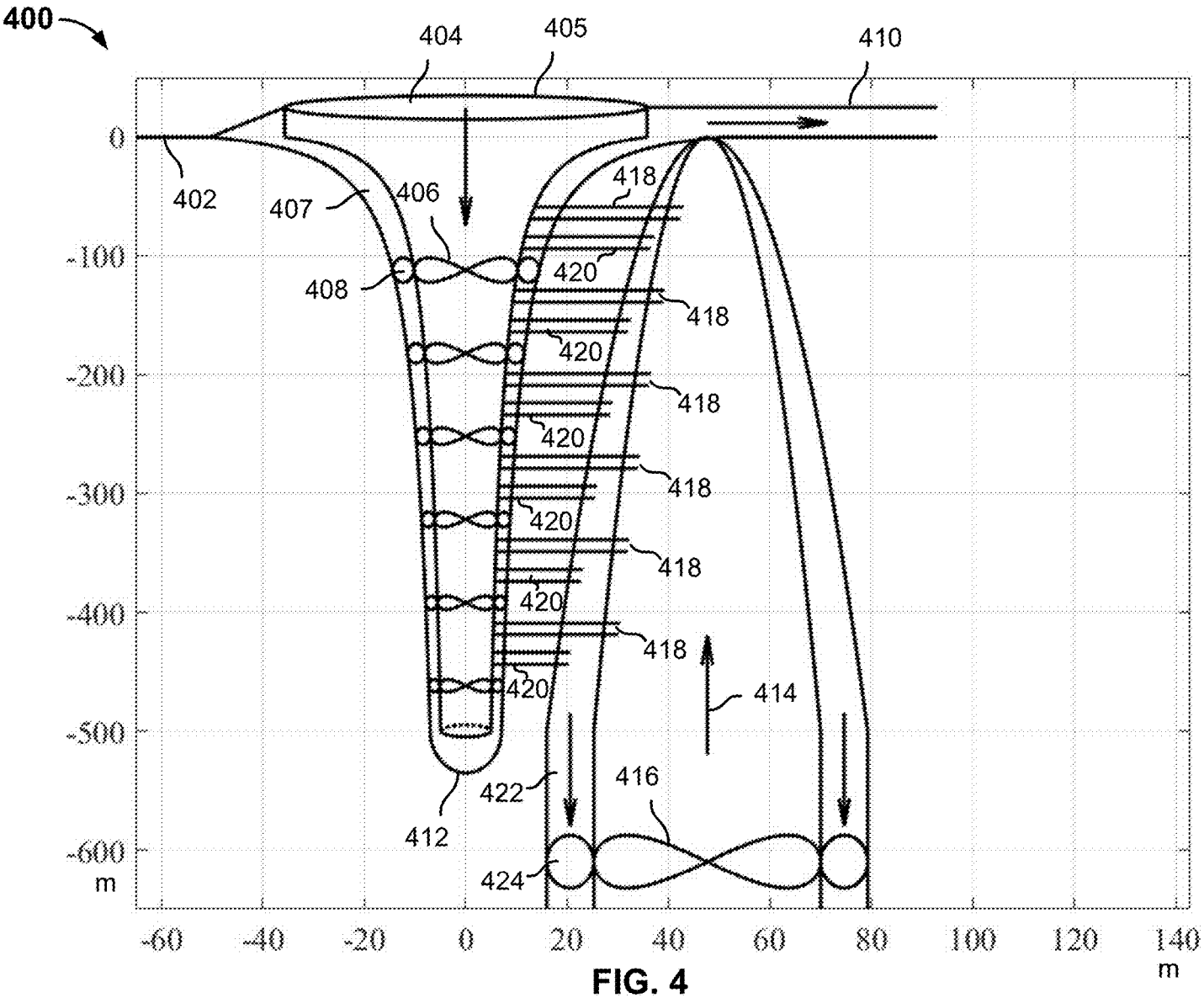
FIG. 4 illustrates an embodiment of a compressor system as disclosed herein in which intake air is cooled using seawater from the deep ocean.

FIG. 4 illustrates an embodiment of a compressor system as disclosed herein in which intake air is cooled using seawater from the deep ocean. In the example shown, compressor 400 position in the ocean 402 draws air into an intake pathway 404 defined by inner tube 405. The air in intake pathway 404 is compressed in stages by bifans 406, which are driven by warm, expanding air returning via return pathway 407 impinging on and driving bifan blades 408 disposed in the return pathway 407. At the surface, returned air exists via a duct 410, which displaces the air laterally, e.g., to avoid immediate reingestion, such as may be necessary in a us of compressor 400 to remove CO2 from the air. In this example, the deep end of compressor 400, at approximately 550 meters of ocean depth, comprises a turnaround 412, which routes air from the intake pathway 404 to the return pathway 407. In various embodiments, a heat exchanger in or near the turnaround 412 may heat the air to a temperature at which the air is maintained as it travels through the return pathway 407.

In other embodiments, industrial processes not shown in FIG. 4 may be performed at the deep end of the compressor 400. For example, the relatively cold, compressed air may be processed to remove CO2 as disclosed herein. In some embodiments, compressor 400 may be used to generate electricity without using the compressed air for another purpose.

In the example shown in FIG. 4, air in the intake pathway is cooled as it is compressed to maintain a substantially constant temperature, i.e., the air undergoes isothermal compression. In the example shown, cold water 414 is drawn from the deep ocean, e.g., from 1 km depth, by operation of a momentum conserving water bifan 416. The cold water 414 is fed via cold water supply lines 418 to heat exchangers integrated into the inner tube 405, e.g., at locations between the bifans 406. The cold water cools the air to maintain a temperature, e.g., 10° C., in the intake pathway 404. Slightly less cold water returns from the heat exchanger via return lines 420 and flows through return pathway 422 driving blades 424 of water bifan 416 on its way back to the deep ocean via an outlet not shown in FIG. 4.

In various embodiments, warm water from the surface is used to warm air returning to the surface via return pathway 407 using structures not shown in FIG. 4 but which in some embodiments are similar to the cold water loop elements, e.g., 414, 416, 418, 420, 422, and 424, shown in FIG. 4, except inverted to pull warm water down from at or near the surface and supply warm water to heat exchanger in or adjacent to the return pathway 407, to warm the air as needed to maintain a constant temperature for isothermal expansion. In some alternative embodiments, warm water may be pumped conventionally from the surface.

In some embodiments, to maintain the intake air at 10° C., the cold water enters the heat exchanger disposed in or adjacent to the intake pathway at 4° C. The heat from the compressed intake air is conducted through the wall of the heat exchanger, heating the cold water. To maintain heat flow, in some embodiments, the cold water is replaced when it has warmed by 3° C. rather than by 6° C. Similarly, the OML water is replaced when it has cooled by 3° C. rather than by 6° C. The rate of water will then need to be doubled to 50 ml per mole per stage, or 2.66 acre-feet per tree in the case of OML water; however, the amount of heat added to the ocean will not change.

Carbon Removal

In various embodiments, air compressed as disclosed herein may be used, at ocean depth, to perform useful work and/or in an industrial process. One example is CO2 removal.

Figure 5:
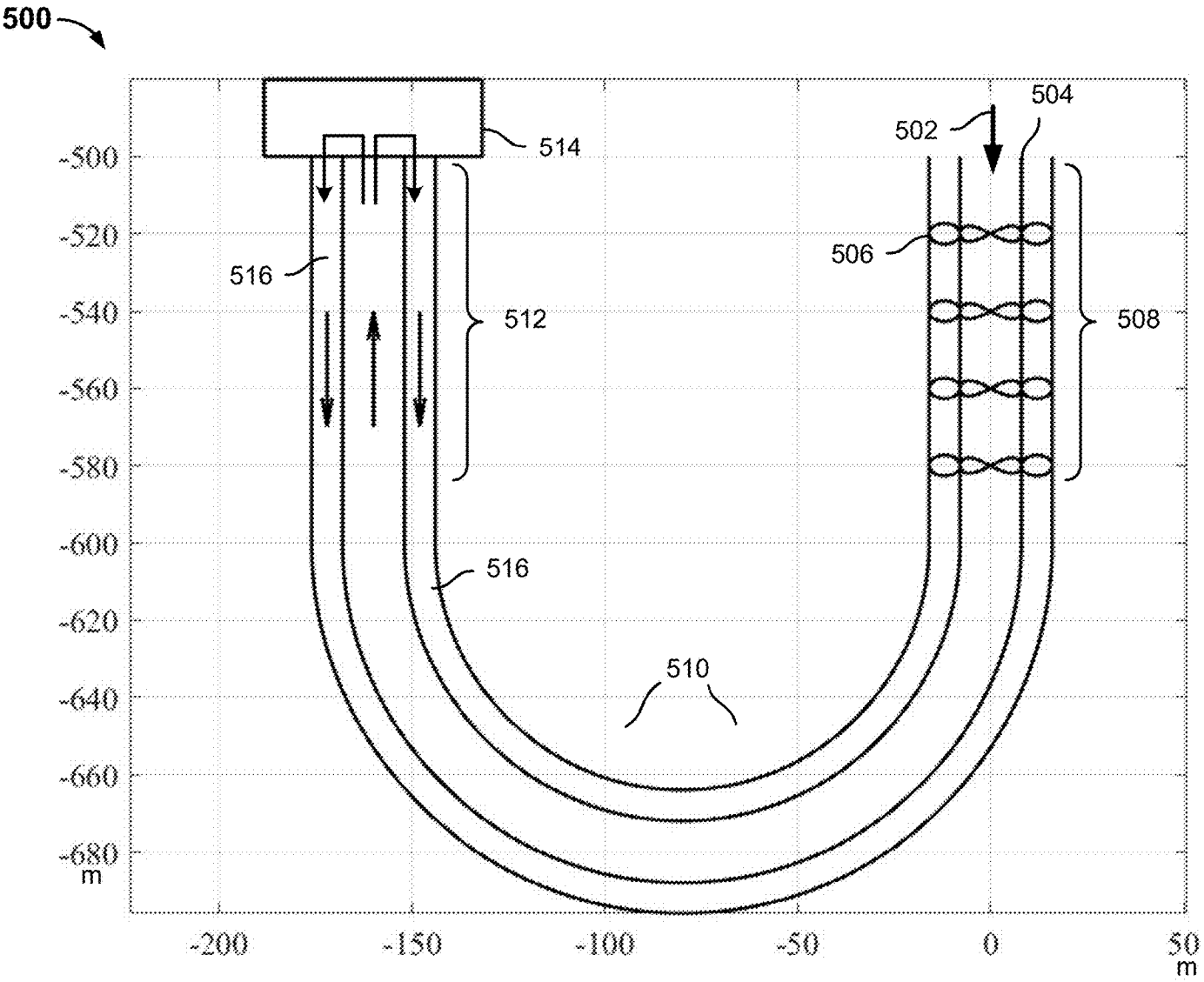
FIG. 5 illustrates an embodiment of a subsystem that extends and uses air compressed by a compressor as disclosed herein to remove CO2 from the compressed air.

FIG. 5 illustrates an embodiment of a subsystem that extends and uses air compressed by a compressor as disclosed herein to remove CO2 from the compressed air. In the example shown, CO2 removal subsystem 500 attaches to a compressor as disclosed herein. For example, rather than terminate at a turnaround 412, as shown in FIG. 4, the intake pathway 404 of FIG. 4 may be extended and the air 502 compressed and cooled by compressor 400 may flow into intake pathway continuation defined by inner tube extension 504. Bifans 506 move air through a first segment 508 in which isothermal compression continues. The compressed air traverses a turnaround segment 510 before entering a final segment 512 through which the air undergoes adiabatic expansion and heat transfer that reduces the temperature to about −130° C. as the air enters a CO2 removal unit 514. At that very low temperature, dry ice is used to provide nucleation sites or surfaces on which CO2 condenses to become solid CO2, which optional is encapsulated prior to being ejected into the ocean, e.g., at a depth at which the $CO_2$ would sink to the ocean bottom.

As shown in FIG. 5, the extremely cold air in CO2 removal unit 514 returns via annular return pathway 516. Unlike the air pathways in the compressor section (e.g., FIG. 4), the inner tube and outer shell in the range 512 are not insulated from one another, allowing cold air in the return pathway 516 to be used to cool the air arriving via the inner tube which, as noted above, also cools by undergoing adiabatic expansion. The returning air warms as a result of such heat transfer and is further warmed to 22° C. (or another target temperature) prior to entering the return pathway of the compressor, such as compressor 400 of FIG. 4.

Use of Graphene

During the past decade, the National Graphene Institute, NGI, at the Uni-versity of Manchester in the UK, https://www.graphene.manchester.ac.uk/ngi/, has greatly developed and applied graphene. One application applicable to syn-trees is as a coating preventing growth of marine life on surfaces, which as reported by the NGI has already been used on a ship.

An important property of graphene is its very high thermal conductivity. We propose to incorporate graphene in the plastic used to construct the heat exchanger so that heat of the compressed air is conducted much faster to the cooling water, even when the temperature differential across the wall of the heat exchanger is varying between only 3 and 6° C.

Conveying OML Water to the Tree

We propose to skim the top 20 meters of the nearby 28° C. oceanic mixed layer towards the tree starting from 400 meters out from the tree's central axis. At this distance, 2.66 acre-feet (3280 cubic meters) per second will be flowing through a perimeter of area half a million square meters with a velocity of 6 cm/see or 12 feet per minute. To maintain this low velocity we propose a plastic skirt around the tree whose depth below the surface is inversely proportional to its distance from the central axis of the tree. Hence when the skirt is 20 meters out, its depth will have increased to 400 meters. The volume of this body of water is on the order of 20 million cubic meters or 16 thousand acre-feet.

Experience will permit fine tuning these numbers.

In various embodiments, the intake pathway may be either the inner, substantially cylindrical pathway defined by the inside surface of the inner tube or the annular outer pathway bounded by the outside surface of the inner tube and the inside surface of the outer shell. In some embodiments, the inner, substantially cylindrical pathway is used as the intake pathway so that the relative warm ocean mixing layer (OML) water reaches the air in the return pathway sooner. In such an embodiment, the cold water may be moved through a central axle, if present, or carried via insulated pipes into heat exchangers on or comprising the inner tube to cool the air in the intake pathway.

Pumping both temperatures of water into the tree can be accomplished with suitably rectified wave action from inertia-gravity waves of periods on the order of hours. The low-pressure tropical waves that move along the ITCZ, and large-scale Rossby waves influenced by meridional movement of the ITCZ might also serve, though their periods may be too long to be practical. The momentum of the water external to the tree would be sufficient to smooth out the long periods of the waves driving the motion.

Relating Stages to Depth

A syntree, in various embodiments, comprises ita multistage compressor. With n stages, we number stage boundaries as integers 0, 1, 2, . . . , n−1, n (the "fenceposts") and the stages themselves (the "fences") as half-integers 1/2, 3/2, 5/2, . . . , (2n−1)/2. With three stages, the boundaries would be 0, 1, 2, 3 and the stages themselves would be 0.5, 1.5, 2.5.

Stages multiply pressure but add depth. In this design each stage is multiplied by the same factor. Hence it is convenient to express pressure as eks atm (atmospheres) where s is the stage number starting s=0, 1, 2, . . . and ek is the common factor by which each stage increases the pressure. Stage 0 is understood to be the surface, where the pressure is 1 atm.

However, pressure in the ocean is a linear function of depth, increasing in seawater by even closer to 1 atm per 10 meters than in fresh water. For clarity of exposition we take it to be exactly 1 atm per 10 meters.

We therefore have the following equation relating depth d in meters to stages s, namely $d=10e^{ks}$.

The inverse of this relation is s=In (d/10)/k.

Observing this relationship ensures that internal and external pressure remaining approximately equal at all depths. This property minimizes stress on the walls of the tree for both descending air in the intake and ascending air in the return.

Segment Length

It follows from the foregoing that segment s=3.5 is of length $10e^{4k}-10e^{3k}=10e^{3k}(e-1)=7.183e^{3k}$. Hence with increasing depth, stages grow longer by a factor of ek at each stage.

When the air is moving at constant velocity through all stages, at deeper stages it has more time to equilibrate with the temperature of the heat exchangers.

For stages nearer the surface that have insufficient time to equilibrate, they can be made longer without changing the pressure relationship between stage number and depth by tilting the stage. This will result in a tree that initially, i.e. at low depths, descends at an angle from vertical but gradually straightens out to a vertical tree.

In various embodiments, techniques disclosed herein may be used to produce energy via ocean thermal energy conversion, using air as a working fluid, and/or to provide compressed air at ocean depth, for use to do work and/or in an industrial process, such as CO2 removal.

In various embodiments, a system as disclosed herein achieves one or more of the following:

1. Avoids most storms by operating in the ITCZ.
2. Avoids the significant parasitic cost of pumping deep cold water to the surface by using a countercurrent momentum exchanger.
3. Replaces closed-cycle OTEC based on phase-changing liquid refrigerants at near-ambient temperatures and pressures with open-cycle OTEC based on air at 50 atmospheres and −130° C.
4. Facilitates the design of a synthetic tree that inhales air, extracts 80% of its CO2 while generating electricity, and lasts long enough to fabricate three larger trees from it.
5. Darwin's arithmetic in Chapter III of The Origin of Species for geometric growth of elephant populations indicates how to grow an initial population of 162 affordably small trees to 13,122 full-size trees within seven generations. If each generation can be kept to half a year, this should suffice to flatten the Keeling curve by 2035. This is about when the centennial climate will have reached the 1.5° C. guard rail of the Paris Accord.

With CO2 currently at 425 ppm and with ACO2 rising at 2.02% a year or a factor of $e^2$=7.389 per century, it can be shown that, using a method of extracting 80% of the CO2, it is necessary to process about 1% of the atmosphere per year or about 1.6 million tons a second, which we can approximate as 68.

A scalable self-reproducing carbon-based synthetic tree is disclosed, initially small but after seven generations of scaling will be processing 128 tons of air a second. The initial forest may be started with 162 affordably small trees owned and operated by 81 sovereign parties and 81 "parties with sovereigns". Each tree manufactures one somewhat larger tree per generation for three generations and is then removed from operation. After seven generations each of those 162 initial trees will have produced 81 descendants for a total forest size of 13,122 full-size trees. Since 68/13,122=128, if each full-size tree processes 128 tons of air per second, this will suffice to flatten the Keeling curve.

In various embodiments, this rate is achieved with isothermal Fanno flow as we now describe.

Isothermal Fanno Flow

Adiabatic Fanno flow was invented by the Italian mechanical engineer Gino Girolamo Fanno in 1935 for the case of a constant area air duct. Here we treat the isothermal case for an air duct with area chosen to vary in a way that makes evident the three essential features of Fanno flow, that it conserves all three of mass flow rate $m=\rho(x)v(x)A(x)$, momentum, and energy $E(x)=1/2\rho(x)v(x)^2A(x)$ where x is the distance from the start of the duct.

Conservation of mass flow rate is achieved physically by neither admitting nor losing any air from the duct.

An immediate corollary is conservation of momentum, from the fact that mass flow rate is momentum.

Conservation of energy implies conservation of velocity. Hence $\rho(x)A(x)$ is also conserved, whence $\rho(x)$ varies inversely with A(x). We now consider two cases as x increases, A(x) decreasing and increasing.

When A(x) decreases then $\rho(x)$ must increase, thereby raising pressure. But if that compression occurs adiabatically, temperature will increase. In the isothermal case temperature does not increase so somehow heat must be lost. This can be accomplished by cooling the air sufficiently with a heat exchanger at a somewhat lower temperature.

When A(x) increases then $\rho(x)$ must decrease, thereby lowering pressure. But if that expansion occurs adiabatically, temperature will decrease. In the isothermal case temperature does not increase so somehow heat must be restored. This can be accomplished By heating the air sufficiently with a heat exchanger at a somewhat higher temperature.

But energy is also lost to friction at the walls, which subtracts frictional heating from needed to offset adiabatic compression, requiring less heating from the heat exchanger.

Henceforth we assume that temperature is conserved by sufficient cooling or heating as required. Note that the frictional heating is the irreversible part of isothermal Fanno flow, everything else can be treated as reversible physics including the temperature changes that would have occurred with adiabatic compression or expansion since those are not frictional.

To simplify the algebra, we exploit this by treating expansion simply by changing the sign of time which occurs as an implicit variable in $v=\dot{x}$ and hence also in $m=\rho\dot{x}A(x)$. The one other change this requires is the sign of frictional heating, which now must be the frictional cooling that would be expected with time reversal.

OTEC From Fanno Flow

We start with air at the entrance to a cylindrical compression duct, hence with decreasing A(x). As customary with Fanno flow, x=0 at the entrance and increases towards the exit, having reached x=L where L is the length of the compression duct. Both temperature and velocity are held constant, i.e. they are independent of x.

When the air exits the compression duct, it is returned to where the air entered the compression duct via an annular duct surrounding the compression duct. By modeling the return as a function of reversed time, we can use the same x as for the compression duct, entering the annular duct at x=L and exiting it at x=0, effectively returning the air back to past via a different route.

In this way we can coordinate $\rho(x)$, v(x), and A(x) for each of the two ducts. While not the same, we will maintain a constant ratio between them. Those variables for the annular duct will be respectively less than, greater than, and equal to those of the cylindrical duct.

Suitably chosen ratios implement OTEC using deep and surface water in the cylindrical and annular ducts, respectively.

The Darcy-Weisbach Friction Term

The Darcy-Weisberg equation governing loss of energy to wall friction is derived starting from the wall shear stress $\tau_{wall}$, understood at each longitudinal position x as the force dF resisting the flow of air caused by the ring of diameter D of longitudinal length dx responsible for the wall shear stress there. dF is proportional to the area of this ring, namely TID dx. It is also proportional to the kinetic energy density of the flowing air, namely 1/2 $\langle v\rangle^2$. Hence we can write $$dF=f_{Fanning}\pi D dx\cdot 1/2\rho\langle v\rangle^2$$

where f is the Fanning friction parameter, an empirically determined constant depending on Reynolds number and wall smoothness that can be read off the Moody diagram.

Dividing both sides by $A=1/4\pi D^2$, and moving dx to the left yields the Darcy-Weisberg relation $$\frac{dP}{dx} = \frac{4f_{Fanning}}{D} 1/2p\langle v\rangle^2$$

The Darcy friction factor is defined as $f_{Darcy}=4f_{Fanning}$, thereby eliminating the remaining number from the equation, and is the one we shall denote by f in the sequel. If expansion is the case where time is reversed, the Darcy-Weisbach friction term should be treated as positive for compression and negative for expansion.

In the ocean, with x as depth, dP/dx is about ten kilopascals per meter, a positive constant. Suitable equations then determine how ρ, v, and A should vary with pressure P so as to maintain dP/dx at that constant level in both the compression and expansion ducts, thereby minimizing stress on the walls.

CO2 Extraction

In various embodiments, each tree compresses air to 5 MPa or 50 atmospheres, cools it to −130° C., and blows it gently through thin sheets of dry ice.

CO2 condenses onto the dry ice at a rate given by the Hertz-Knudsen-Schrage equation. As the sheets thicken, the leading edge is ground off and separated into what is needed to maintain the sheets at the trailing edge and what can be sequestered or used to make various kinds of plastic, pyrolytic graphite, and carbon-based insulated wire for manufacturing more trees and plastics for the plastics industry.

The cooling to −130° C. is accomplished, in various embodiments, by adiabatic expansion which subtracts some 15 or 16° C. from the temperature, multiplied to subtraction of −140° C. using a countercurrent heat exchanger.

FIG. 6A plots the partial pressure of CO2 in pascals at temperatures between −135 and −125° C. At −130° C. the partial pressure is about 200 Pa. FIG. 6B displays the condensation rate of CO2 (500-2000 Pa partial pressure) onto one square meter of dry ice, measured in grams per second.

If a hundred thin 1×1 meter sheets of dry ice are suspended vertically in a cubic meter box, spaced 1 cm apart, they present a surface of 100 m2. Air at 400 ppm at a pressure of 5 MPa has an initial partial pressure of 2000 Pa. Hence that air entering this box at the bottom will precipitate at an initial rate of 10 kg per second, slowing down considerably as the partial pressure of CO2 decreases to 500 ppm. At that level CO2 will be down to 100 ppm and can be returned to the surface.

To cool air to −130° C. at 5 MPa at depth 500 m, compress it to 6 MPa at depth and then route it up 100 m to 500 m depth, expanding it adiabatically as it rises. On its own this only enough to cool it by some 14° C. A 90% efficient counter-current heat exchanger can multiply this rise tenfold, obtaining a decrease from 10° C. to −130° C. This heat exchanger consists of the return flow of the cold air back down to 600 m depth, organized as an annular pipe wrapped around the ascending air. It works by being sufficiently colder all the way back down to 600 m than the rising air in the inner pipe, so that 10% of the cooling comes from the adiabatic expansion and 90% from descending air in the annular pipe.

This returning air arrives at about 0° C. Then it is heated to 22° C. and isothermally returned to the surface through the annular expansion tube, as described above in connection with FIG. 5.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system, comprising:

a pair of substantially vertically oriented concentric tapered tubular structures having a first, larger diameter end positioned at or near an ocean surface and a second, smaller diameter end positioned at an ocean depth, the pair of tubular structures including an inner tube that defines an inner, substantially cylindrical pathway for air to travel in a first substantially axial direction and an outer shell having a shell diameter that is larger than an inner tube diameter of the inner tube, an inner surface of the outer shell and an outer surface of the inner tube defining a substantially annular pathway for air to travel in a second substantially axial direction substantially opposite the first substantially axial direction; and one or more bifans each rotatably mounted at a corresponding axial location along a central vertical axis of the pair of substantially vertically oriented concentric tapered tubular structures, each bifan comprising:

an inner set of fan blades disposed in the substantially cylindrical pathway defined by the inner tube;

an outer set of fan blades disposed in the substantially annular pathway between the inner tube and the outer shell; and a motor configured to operate in a motor mode to drive the bifan and a generator mode to generate electricity when driven by air flowing through either the inner set of fan blades or the outer set of fan blades of the bifan;

wherein air enters via an intake pathway comprising one of the inner, substantially cylindrical pathway or the outer, substantially annular pathway and is compressed substantially isothermally as the air travels through the intake pathway to the opposite end of the intake pathway, at the ocean depth, the movement of air through the intake pathway being facilitated at least in part by those blades of the plurality of bifans disposed in the intake pathway; and the compressed air expands substantially isothermally and returns to the ocean surface via the other of the inner, substantially cylindrical pathway or the outer, substantially annular pathway, said pathway comprising a return pathway, the rising and expanding air driving the one or more bifans by impinging on those blades of the bifans disposed in the return pathway.

2. The system of claim 1, wherein the pair of substantially vertically oriented concentric tapered tubular structures comprises a plurality of vertical segments.

3. The system of claim 2, wherein each vertical segment comprises a pair of concentric inverted conical frustums.

4. The system of claim 1, wherein air in the intake pathway is cooled using deep ocean water.

5. The system of claim 4, wherein air in the intake pathway is maintained at approximately° C. using deep ocean water at approximately 4° C.

6. The system of claim 4, further comprising a cooling water subsystem configured to draw cooling water from the deep ocean and provide cooling water to one or more heat exchangers positioned in or adjacent to the intake pathway.

7. The system of claim 6, wherein the cooling water subsystem comprises a water bifan comprising a first set of blades positioned to draw cold water from the deep ocean and drive the cold water towards the surface and a second set of blades positioned to be driven by warmer water returned via a return path by which water warmed in said one or more heat exchangers is returned to the deep ocean.

8. The system of claim 1, wherein the intake path brings the air to a depth of approximately 550 m.

9. The system of claim 1, wherein the air is compressed to greater than 5 MPa at a temperature of approximately 10° C.

10. The system of claim 9, wherein the compressed air is warmed at the ocean depth to approximately 22° C.

11. The system of claim 10, wherein the warmed air is returned via the return pathway.

12. The system of claim 11, wherein substantially isothermal expansion of air is achieved at least in part by warming air in the return pathway using oceanic mixed layer (OML) water at approximately 28° C. to maintain air in the return pathway at approximately 22° C.

13. The system of claim 1, wherein carbon dioxide ($CO_2$) is removed from the air prior to the air being returned via the return pathway.

14. The system of claim 13, wherein to facilitate $CO_2$ removal the compressed air is further cooled to approximately −130° C.

15. The system of claim 13, wherein $CO_2$ removed from the air is removed in liquid or solid form.

16. The system of claim 13, wherein $CO_2$ removed from the air is ejected into the deep ocean.

17. The system of claim 16, wherein $CO_2$ removed from the air is encapsulated prior to being ejected into the deep ocean.

18. The system of claim 13, wherein $CO_2$ removed from the air is ejected into the deep ocean in liquid form at a depth at which the liquid $CO_2$ is denser than the surrounding sea water.

19. The system of claim 13, wherein $CO_2$ removed from the air is used in an industrial process.

20. The system of claim 1, further comprising an energy capture subsystem configured to provide to a destination excess energy generated by the respective motors associated with the plurality of bifans when operating in the generator mode.

21. The system of claim 20, wherein the destination comprises a battery and the energy capture subsystem is configured to charge the battery.

22. The system of claim 20, wherein the destination is associated with an industrial process and the excess energy is used to power the industrial process.

* * * * *